US009901224B2

(12) United States Patent
Rubashkin

(10) Patent No.: US 9,901,224 B2
(45) Date of Patent: Feb. 27, 2018

(54) TOILET SEAT LIFTER

(71) Applicant: Yosef Rubashkin, Brooklyn, NY (US)

(72) Inventor: Yosef Rubashkin, Brooklyn, NY (US)

( * ) Notice: Subject to any disclaimer, the term of this patent is extended or adjusted under 35 U.S.C. 154(b) by 0 days.

(21) Appl. No.: 14/577,677

(22) Filed: Dec. 19, 2014

(65) Prior Publication Data

US 2015/0173574 A1 Jun. 25, 2015

Related U.S. Application Data

(60) Provisional application No. 61/918,208, filed on Dec. 19, 2013.

(51) Int. Cl.
*A47K 13/10* (2006.01)
*A47K 13/24* (2006.01)

(52) U.S. Cl.
CPC ..... *A47K 13/10* (2013.01); *A47K 13/245* (2013.01)

(58) Field of Classification Search
CPC ..... A47K 13/10
USPC ..... 4/246.1, 246.2–246.5
See application file for complete search history.

(56) References Cited

U.S. PATENT DOCUMENTS

| | | | | |
|---|---|---|---|---|
| 622,383 | A * | 4/1899 | O'Brien | A47K 13/10 16/307 |
| 6,138,289 | A * | 10/2000 | Sardo | A47K 13/10 4/246.1 |
| 6,163,894 | A * | 12/2000 | Simonds | A47K 13/105 4/246.1 |
| 6,601,241 | B1 * | 8/2003 | Skotzke | A47K 13/10 4/246.1 |
| 8,479,323 | B2 | 7/2013 | Blum | |
| 2005/0060923 | A1 * | 3/2005 | Ardern, II | G09F 7/02 40/658 |
| 2009/0199331 | A1 | 8/2009 | Tong | |
| 2013/0117918 | A1 | 5/2013 | Tian | |
| 2013/0219602 | A1 | 8/2013 | Korzelski | |

* cited by examiner

*Primary Examiner* — Christine Skubinna
(74) *Attorney, Agent, or Firm* — Global Intellectual Property Agency, LLC; Daniel Enea

(57) ABSTRACT

The present invention is an improved and retrofitted attachment clip for toilets that allows the toilet seat to maintain an upright position. The toilet seat lifter comprises a rectangular plate attached thereto a clip via a spring-loaded hinge, wherein the spring-loaded hinge includes a torsion spring. In operation, the device removably attaches thereto the back rim of the toilet so that the upper end of rectangular plate lays against the underside of the toilet seat. In some embodiments, the present invention further includes a pair of arms that fasten to the toilet seat to ensure that the device is secured onto the toilet seat. The present invention maintains the rectangular plate and the toilet seat in an upright position. The toilet seat can be placed down by applying an external force. When the external force is released the toilet seat returns to an upright position.

7 Claims, 4 Drawing Sheets

TOILET SEAT LIFTER

CROSS REFERENCE TO RELATED APPLICATION

This application claims the benefit of U.S. Provisional Application No. 61/918,208 filed on Dec. 19, 2013. The above identified patent application is herein incorporated by reference in its entirety to provide continuity of disclosure.

BACKGROUND OF THE INVENTION

Field of the Invention

The present invention relates to bathroom accessories. More specifically, the present invention pertains to an improved attachment clip for a standard toilet that aids in promoting hygiene and cleanliness. The toilet seat lifter is designed to be retrofitted onto a toilet and keep the toilet seat in an upright position unless external pressure is applied to push the seat into a horizontal position.

Should the toilet seat be left up or down? The question arises, especially, when people of opposite genders share one bathroom. Common bathroom etiquette states that it is courteous and considerate to put the seat down after use. Naturally, as men are the only ones that may require the seat in an upright position, men are primarily responsible for placing the seat up and down. However, quite often, men forget to place the seat down after use. Frequently, horror stories are told where women wake up half asleep in the middle of the night to use the bathroom, and then they involuntarily wake up as their hearts skipped a beat in lieu of falling into the toilet.

Women argue that the toilet seat should always be left down because they do not want to have to look down before they sit down. Furthermore, because men stand in front of the toilet and have to aim, they are already required to look down, and the onus should be on them to adjust the seat up or down accordingly. Men often acquiesce to women and their demands, but such a chore can be easily forgotten or some men cannot be bothered by having to raise or lower the seat.

Accordingly, the task allotted to men by common bathroom etiquette can be seen as bothersome or arduous. If the problem is so difficult for men, then it is reasonable for both men and women to shoulder a share of the responsibility. A potential solution is for the seat to remain in the upright position. Both men and women will need to be more attentive to advance their own needs.

The present invention provides a retrofitted attachment that is configured to maintain the toilet seat in an upright position. The present invention is adapted to promote hygiene and prevent urine from splattering the toilet seat. In a preferred embodiment, the present invention comprises a clip, a spring-loaded hinge, and a rectangular plate. The clip attaches the device to the back of a toilet between the rim and the seat. The rectangular plate is hingedly attached to the clip and there is a torsion spring set within the hinge to push the rectangular plate upright.

In operation, the device removably attaches thereto the back rim of the toilet so that the upper end of rectangular plate lays against the underside of the toilet seat. The present invention maintains the rectangular plate and the toilet seat in an upright position. The present invention also may include a pair of arms that further fasten with the toilet seat and maintain its upright position. A toilet seat with the present invention attached to it can still be placed in a horizontal configuration when an external pressure is applied by pushing the toilet seat down into a horizontal configuration. When the external force is released the toilet seat returns to an upright position.

Description of the Prior Art

Devices have been disclosed in the prior art that relate to vertically held toilet seats. These include devices that have been patented and published in patent application publications. Some of these devices disclose devices that attach to the rear of the toilet seat. Other devices require the hinges on the toilet seat and disassembly or replacement of the toilet seat is required. These devices, however, do not disclose a removably attached device that can attach to the bottom rim of the toilet to maintain a toilet seat in an upright position. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Patent Application. No. 2009/0199331 to Tong is a lift apparatus for a toilet seat attached on the rear end of the toilet seat to keep the toilet seat in upright position. The toilet seat is pushed downward with external force when needed. The lift apparatus uses a spring plate with a hook, small plate supporter, and a plate stand. The hook attaches to the rear end of the toilet seat. The small plate supporter rests on top of the toilet to prevent the toilet seat from overturning backwards. The plate stand rests on the top of toilet to keep the toilet seat at upward position. While Tong discloses a device for maintaining a toilet seat in an upright position, the device of Tong differs from the present invention in that it uses a pull mechanism to lift the toilet seat upright. In contrast, the present invention removably clips to the back rim of the toilet seat, and the torsion spring pushes the rectangular plate and toilet seat upright. In addition, the Tong device can be utilized only with a toilet that has a seat, but not a compatible toilet lid. In contrast, the current device attaches to the bottom rim of the toilet, which enables the current device to push a toilet seat upright with or without the toilet lid.

Similarly, U.S. Patent Application. No. 2013/0117918 to Tian is another device to keep the toilet seat upright. The Tian device is installed to the hinges of a toilet seat. It uses torsion springs connected to the hinges of the toilet seat to keep the toilet seat and cover in an upright position. The seat can be placed downward with a downward force against the torsion springs. As the Tong device attaches to the hinges of a toilet seat, toilet seat and cover must be separated from one another in order to install the device for use. Here, the current invention does not impose such a requirement. The current device is retrofitted onto the toilet by clamping onto the back rim of the toilet seat.

Additionally, U.S. patent application No. 2013/0219602 to Korzelski is also an automatic toilet seat lifter having rotary spring-loaded actuators that are coupled with a control device to lift and lower the toilet seat in a hands-free manner. The spring-loaded actuators comprise rotary modules and springs that are mounted on a pipe. The rotary modules are adapted to attach to the hinges of a toilet seat, so that the device is mounted at the rear part of the toilet seat, near the water tank. In contrast, the present invention comprises a torsion spring and a base that pushes the toilet seat into an upright position, wherein the base is attached to an underside of the toilet seat.

U.S. Pat. No. 8,479,323 to Blum relates to a spring-mounted vertically held toilet seat. The Blum device uses a pull handle that is connected to a mechanism that is associated with lifting the seat to a vertical rest position. The toilet seat lifting assembly comprises a toilet seat including two fixed hinge supports, an outer casing arranged between the two hinges, a pull handle having a shaft and a base rod, the shaft being connected in a four-bar-link via a first pin to a link, and the link being connected via second pin with a pivotal L-shaped link. When the pull handle is pivoted out of the vertical rest position, the torsion spring is tensioned. Upon relaxing the pull handle, the torsion spring forces the seat up to move back into the vertical position. The invention can be used to retrofit on an existing toilet pedestal by replacing the standard toilet seat or can be included on a new toilet pedestal when the pedestal is installed.

The Blum device requires that the existing toilet seat be replaced, which is not required of the current invention. The current device does not use a pull handle or require to attach moving parts to the hinges to keep the toilet seat in a stationary upright position. The current device can also be retrofitted to fit any toilet seat, whereas the Blum device requires the existing toilet seat to be replaced.

The devices disclosed in the prior art have several known drawbacks. These devices are limited as they require the use of the hinges in the toilet seat which would require disassembly or replacement. Some of these prior arts also attach to the rear lip of the toilet. The present invention overcomes these limitations by providing a clip can easily be retrofitted onto any toilet. The present invention removably attaches onto the bottom rim of the toilet and uses a torsion spring and a rectangular plate to maintain the toilet seat in an upright position. A toilet seat with the present invention attached to it can still be placed in a horizontal configuration when an external pressure is applied by pushing the toilet seat down into a horizontal configuration.

It is therefore submitted that the present invention is substantially divergent in design elements from the prior art, and consequently it is clear that there is a need in the art for an improvement to vertically held toilet seats. In this regard, the instant invention substantially fulfills these needs.

SUMMARY OF THE INVENTION

In view of the foregoing disadvantages inherent in the known types of toilet accessories now present in the prior art, the present invention provides a new and improved toilet seat lifter for toilet seats wherein the same can be utilized for maintaining toilet seats in an upright position.

It is therefore an object of the invention to provide a new and improved toilet seat lifter to toilets that has all of the advantages of the prior art and none of the disadvantages.

Another object of the present invention is to provide a new and improved toilet seat lifter to toilets that is easily removably and retrofitted to any standard toilet.

Another object of the present invention is to provide a new and improved toilet seat lifter that comprises a clip, a spring-loaded hinge, and a rectangular plate, wherein the rectangular plate is adapted to attach to the back rim of a toilet seat.

Still yet another object of the present invention is to provide a new and improved toilet seat lifter that utilizes a torsion spring that maintains the toilet seat in an upright position, and that allows the toilet seat to be lowered when pressure is exerted on the toilet seat.

Still yet another object of the present invention is to provide a new and improved toilet seat lifter wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
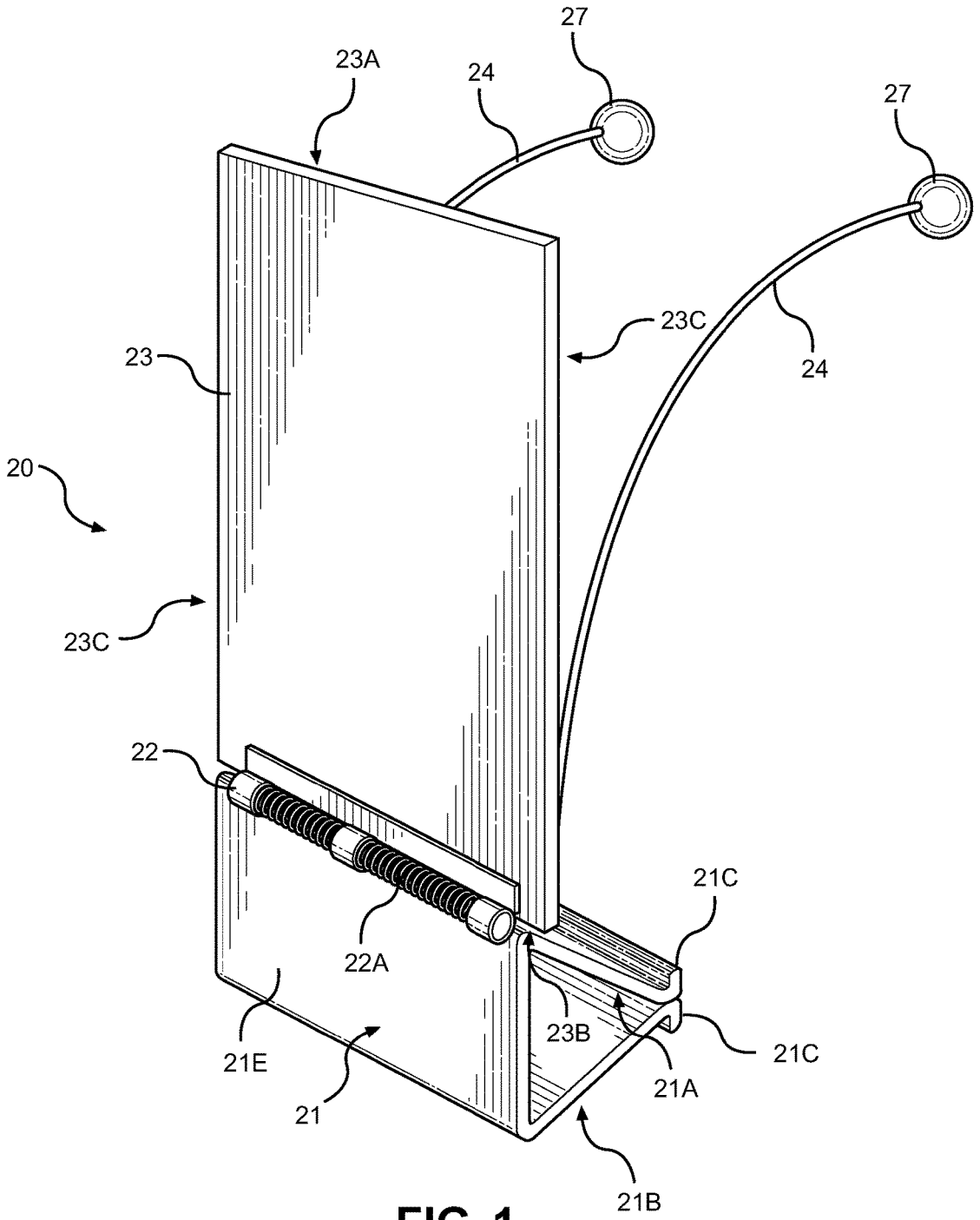
FIG. 1 shows a perspective view of the preferred embodiment of the present invention.

References are made herein to the attached drawings. Like reference numerals are used throughout the drawings to depict like or similar elements of the toilet seat lifter. For the purposes of presenting a brief and clear description of the present invention, the preferred embodiment will be discussed as used to maintain toilet seats in an upright position. The figures are intended for representative purposes only and should not be considered to be limiting in any respect.

Referring to FIG. 1 there is shown a view of the preferred embodiment of the toilet seat lifter 20. The toilet seat lifter 20 comprises of a clip 21 having a rectangular plate 23 attached thereto via a spring-loaded hinge 22. It is contemplated that the clip 21 may be composed of flexible metal or other suitable material, and the plate 23 may be composed of rigid material such as metal or plastic. Further, the clip 21 and the plate 23 may be anti-bacterial. In the illustrated embodiment, the clip 21 also includes a pair of elongated arms 24. The clip 21 is configured to attach to the rear rim of the toilet. The clip 21 comprises a base 21E, a first side 21A, and a second side 21B, wherein the two sides 21A, 21B extend from the base 21E and are biased toward each other to form an apex. When viewed from the side, the clip 21 comprises a substantially triangular cross section. Each of the two sides 21A, 21B comprises a terminal edge that curls outward, so as to form a looped edge 21C. Tension along the base 21E of the clip 21 forces the two sides, 21A, 21B, closed, such that the looped edges 21C of the two sides 21A, 21B directly contact one another.

The two sides 21A, 21B, can be moved apart such that the clip 21 is in an open configuration. In an open configuration, the clip 21 can attach to a rear portion of a toilet rim such that the base 21E of the clip 21 rests flush against the side of the rim of the toilet; the first side 21A rests flush against the top of the rim; and the second side 21B rests flush against the bottom of the rim. The loops 21C prevent the edges of the first and second sides 21A, 21B from cutting into the rim of the toilet.

In some embodiments, each of the loops 21C are adapted to hold removable handles 21D thereon. Each of the handles 21D comprises an elongated wire having two terminal ends, wherein each of the ends are disposed within the loops 21C so as to form a closed loop. It is contemplated that the wire comprises a circular cross section with a diameter that is less than a diameter of a cross section of the loop 21C such that the wire can freely rotate within the loops 21C. The handles 21D that can be squeezed together to move the sides 21A, 21B apart such that the clip 21 is open. The handles 21D can be removed from the clip 21 by squeezing them sideways and pulling them out from the loops 21C.

The rectangular plate 23 is hingedly attached to the clip 21 via a spring-loaded hinge 22, or other suitable fasteners. The rectangular plate 23 comprises an upper end 23A, a lower end 23B, and opposing side ends 23C. The distance between the upper end and the lower end defines a length of the rectangular plate 23; and the distance between the two side ends 23C define a width of the rectangular plate 23. The lower end 23B of the rectangular plate 23 is attached to the clip 21 where the base 21E connects to the first side 21A. The spring-loaded hinge 22 spans the width of the base 21E of the clip 21 so that the entire lower end of the plate 23 is hingedly connected thereto. Thus, the width of the plate 23 is substantially equal to the width of the base 21E of the clip 21. In operation, the upper end of the plate 23 contacts an underside of a toilet seat to prevent the seat from lowering, thereby maintaining the toilet seat in an upright manner. Additionally, the rectangular plate 23 is dimensioned so that the upper end 23A of the plate 23 does not extend beyond the underside of the toilet seat. In this way, the plate 23 does not protrude into the recess afforded by the toilet seat.

In the illustrated embodiment, spring-loaded hinge 22 comprises a torsion spring 22A. The torsion spring 22A is adapted to keep the rectangular plate 23 upright in its starting portion, thereby also maintaining a toilet seat in an upright position. When an external force is applied, the rectangular plate 23 can be moved into a horizontal position, whereby the toilet seat can be moved downward. When the external force is released, the torsion spring 22A will return to its starting position, and the rectangular plate 23 will return to its upright position.

In the illustrated embodiment, the present invention comprises a pair of arms 24. Each of the arms 24 comprises an elongated wire having a first end and a second end. The first end of the wire is attached to the side 21A of the clip 21, and the second end comprises a circular tip 27. The arms 24 are bent such that the circular tips 27 point away from the rectangular plate 23. In operation, the arms 24 are positioned so that the first ends of the arms 24 are disposed at the top of the rim of the toilet on the underside of the toilet seat, and the circular tips 27 extend over the topside of the toilet seat. The arms 24 are dimensioned so that the circular tips 27 are locked into position when it extends over the topside of the toilet seat. In this way, the arms 24 provide additional fastening means to secure the present invention 20 to the toilet on which it is mounted.

Figure 2:
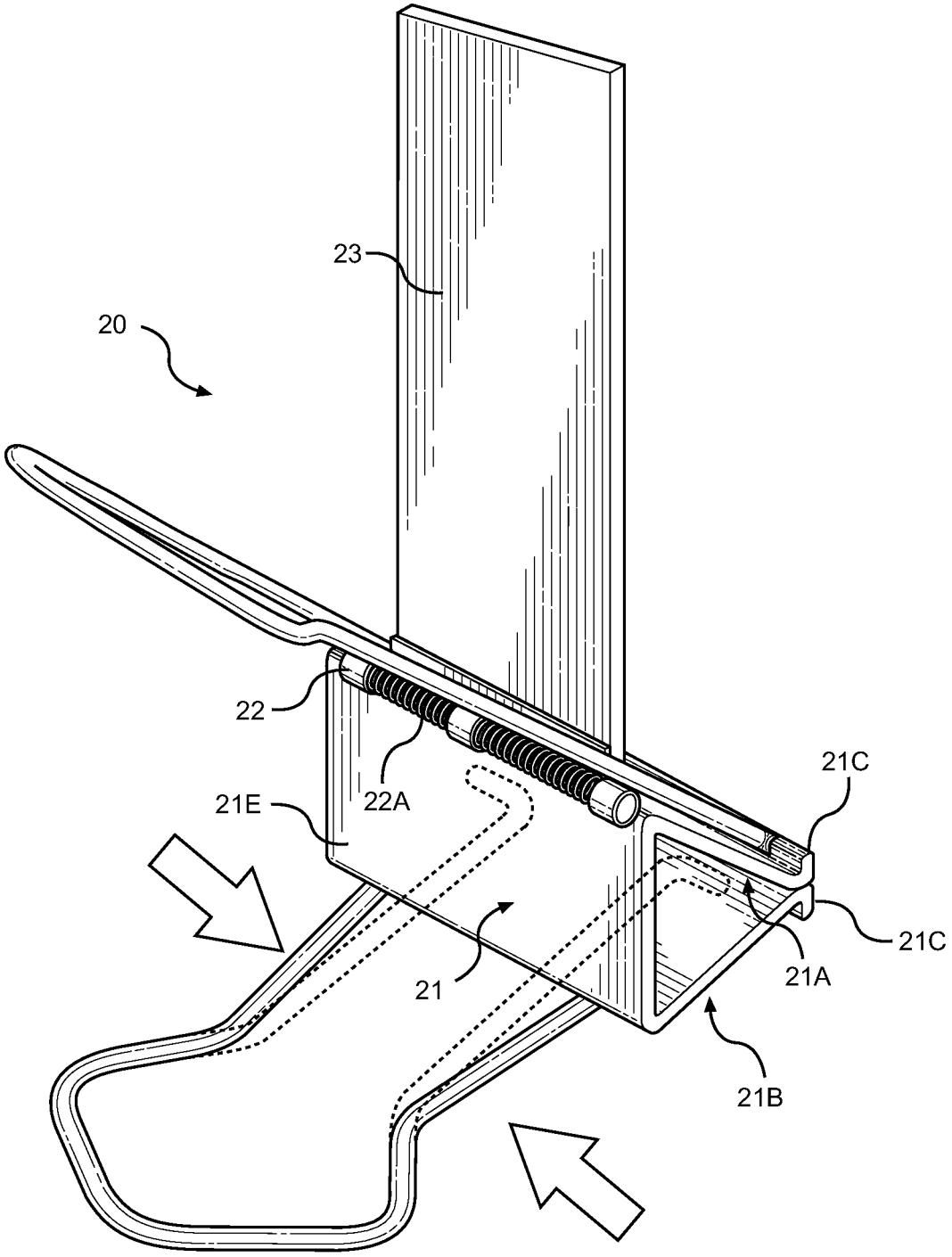
FIG. 2 shows a view of the present invention as installed on a toilet seat.

Referring to FIG. 2, there is shown a view of the present invention as attached to a toilet. The toilet seat lifter 20 can be retrofitted to any existing or new toilets, and can be removably attached thereto without requiring any disassembly of the toilet. The clip 21 is clamped onto the rear rim of the toilet such that the base of the clip 21 is flush against the side of the rim, and the sides of the clip 21 are clamped on top and bottom of the rim. In its starting position, the torsion spring 22A of the spring-loaded hinge 22 is in a relaxed state, and it forces the top end of the rectangular portion 23 to directly contact the underside of the toilet seat, such that the plate 23 pushes the seat in the upright position and prevents the seat from falling down.

To move the seat into a horizontal position, the seat is moved down, whereby pushing the seat down exerts pressure on the torsion spring 22A. As the pressure is applied to the spring 22A, the spring 22A is squeezed. This allows the plate 23 to move downward into a substantially horizontal position, whereby moving the plate 23 allows the toilet seat to move into the down position. As such, when the user is sitting on the toilet seat, the seat stays in a down position. When the toilet seat is not pushed down, the pressure is released from the torsion spring 22A, thereby allowing it to relax and move back to its starting position, returning the plate 23 and the toilet seat into the upright position.

Figure 3:
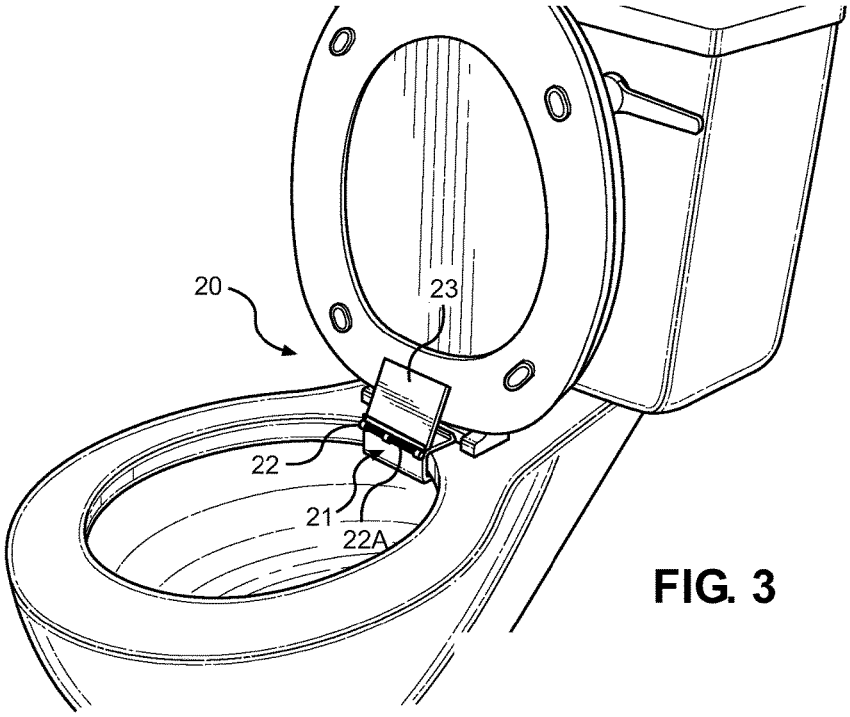
FIG. 3 shows a view of the present invention as being moved into a lowered position.
Figure 4:
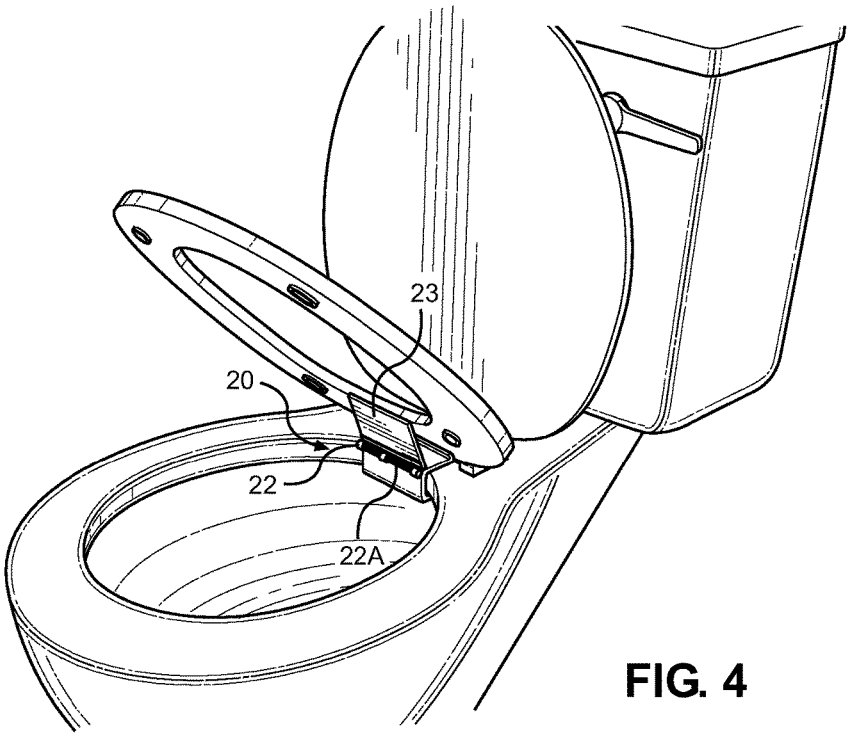
FIG. 4 shows a successive view of the present invention as being moved into a lowered position.

Referring to FIGS. 3 and 4, there are shown successive views of the toilet seat being lowered. Due to the resistance from the torsion spring 22A, an external pressure must be applied to the toilet seat for the toilet seat to be used in a horizontal setting. Additionally, the external force must be consistently applied for the toilet seat to remain in the horizontal setting. The toilet seat lifter 20 does not limit the maneuverability of the toilet seat; the toilet seat can still move between a horizontal and a vertical setting. However, the toilet seat lifter 20 is adapted to create a starting position in the upright position and consistent pressure must be applied to use the toilet in a horizontal setting.

The rectangular plate 23 is positioned on the underside of the toilet seat. The rectangular plate 23 is dimensioned so that it does not protrude into the recess of the toilet seat and does not interfere with any function of the toilet. When the toilet seat is in a down position, only the base 21E of toilet seat lifter 20 remains visible. The toilet may be used in a usual manner, and the toilet seat can automatically return to an upright position. Therefore, the usage, functionality, and appearance of the toilet is not affected by the attachment of toilet seat lifter 20.

Figure 5:
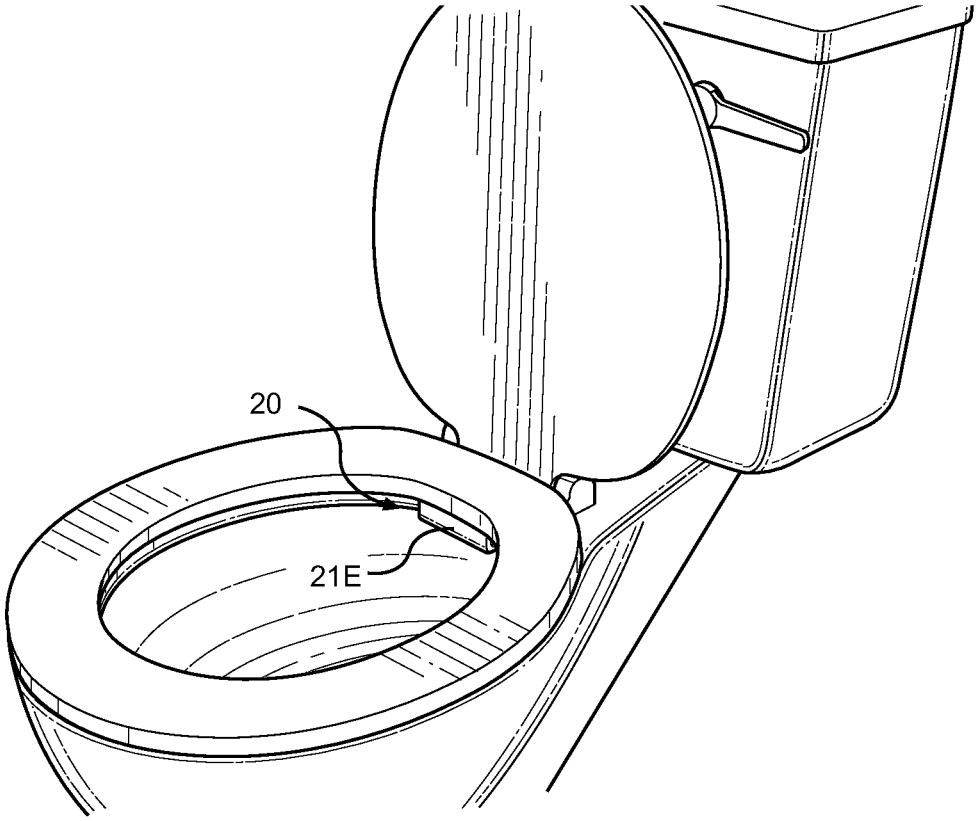
FIG. 5 shows a successive view of the present invention as being moved into an upright position.

Referring to FIG. 5, there is shown a view of the present invention when the external pressured applied thereto has been released and the toilet seat is returning to the default upright position. The torsion spring 22A of the spring-loaded hinge 22 returns to its relaxed state when the seat is released, which in effect pushes the rectangular plate 23 and the toilet seat from the horizontal position back to the default upright position. The toilet seat will remain in the upright position, until an external pressure moves the toilet seat back into a horizontal position.

It is contemplated that the present invention is further adapted to maintain both the toilet seat and the lid in an upright position. As the torsion spring 22A pushes the toilet seat upright, the seat pushes against the lid, thereby moving the lid into an upright position. The toilet seat and lid can both be also moved into a down position by an external force applied to the lid.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat lifter, comprising;

a clip adapted to removably attach to an interior edge of a rear rim of a toilet;

a rectangular plate having a lower end and an upper end;

said lower end of said rectangular plate attached to said clip via a spring-loaded hinge;

wherein the clip is disposed on a first side of the rear rim, the first side of the rear rim disposed towards a center of the toilet;

wherein said rectangular plate is configured to move between an upright position and a horizontal position;

said upper end of said rectangular plate adapted to directly contact an underside of a toilet seat when said rectangular plate is in said upright position;

wherein an axis of the spring-loaded hinge is disposed parallel a pivot of the toilet seat;

the rectangular plate configured to slide along an underside of the toilet seat.

2. The toilet seat lifter of claim 1, wherein said clip comprises a base, a first side and a second side;

each of said first side and said second side having a looped edge.

3. The toilet seat lifter of claim 2, further comprising a pair of removable handles;

each of said pair of removable handles having a first terminal end and a second terminal end;

each of said first terminal end and said second terminal end disposed within said looped edge.

4. The toilet seat lifter of claim 1, wherein said spring-loaded hinge comprises a torsion spring;

wherein said torsion spring moves said rectangular plate into said upright position when said torsion spring is relaxed;

wherein said torsion spring moves said rectangular plate into said horizontal position when said torsion spring is squeezed.

5. The toilet seat lifter of claim 1, further comprising a pair of arms having a first end and a second end;

said first end of said pair of arms attached to said clip;

said second end of said pair of arms having a circular tip;

said circular tip adapted to secure to a topside of said toilet seat.

6. The toilet seat lifter of claim 4, wherein said second end of said pair of arms is bent away from said rectangular plate.

7. The toilet seat lifter of claim 1, wherein said clip comprises a triangular cross section.

* * * * *